US011253881B2

(12) United States Patent
Yang

(10) Patent No.: US 11,253,881 B2
(45) Date of Patent: Feb. 22, 2022

(54) PUMP ASSEMBLY OF NON-METAL PUMP TYPE COSMETIC CONTAINER

(71) Applicant: DONGGI P&I CO., Ltd., Gyeonggi-do (KR)

(72) Inventor: Hyoung Taek Yang, Seoul (KR)

(73) Assignee: DONGGI P&I CO., Ltd., Gyeonggi-Do (KR)

( * ) Notice: Subject to any disclaimer, the term of this patent is extended or adjusted under 35 U.S.C. 154(b) by 0 days.

(21) Appl. No.: 16/998,129

(22) Filed: Aug. 20, 2020

(65) Prior Publication Data

US 2021/0276030 A1 Sep. 9, 2021

(30) Foreign Application Priority Data

Mar. 6, 2020 (KR) ..... 10-2020-0028134

(51) Int. Cl.
*B05B 11/00* (2006.01)
*A45D 34/00* (2006.01)

(52) U.S. Cl.
CPC ..... *B05B 11/3028* (2013.01); *B05B 11/3046* (2013.01); *B05B 11/3052* (2013.01); *A45D 34/00* (2013.01); *A45D 2200/056* (2013.01)

(58) Field of Classification Search
CPC ..... B05B 11/3028; B05B 11/3046; B05B 11/3052; A45D 34/00; A45D 2200/056
USPC ..... 222/207, 215
See application file for complete search history.

(56) References Cited

U.S. PATENT DOCUMENTS 3,452,905 A * 7/1969 Micallef ..... G01F 11/08 222/207
4,088,425 A * 5/1978 Bennett ..... B05B 11/3028 417/444
5,979,711 A * 11/1999 Fuchs ..... B05B 11/0005 222/321.2
6,755,327 B1 * 6/2004 Hazard ..... B05B 11/3035 222/209
10,010,896 B2 * 7/2018 Kraus ..... B05B 11/3077
10,138,971 B1 * 11/2018 Deman ..... B05B 11/3023
2004/0265157 A1 * 12/2004 Fuchs ..... B05B 11/3061 417/569
2015/0136810 A1 * 5/2015 Ding ..... B05B 11/3076 222/321.9

FOREIGN PATENT DOCUMENTS

KR 10-2016853 B1 10/2019

* cited by examiner

*Primary Examiner* — Vishal Pancholi
(74) *Attorney, Agent, or Firm* — The PL Law Group, PLLC

(57) ABSTRACT

A non-metal pump type cosmetic container according to an embodiment of the present invention may efficiently process recycling after use. Also, Due to an operation of the elastic pump that is more flexible than a rigid metal spring, pumping may be achieved and thus a cosmetic material may be sensitively discharged even by a small force, leading to increases in tactile sensitivity and operational sensitivity. In addition, the structure of the elastic pump formed of resin having a relatively good deformation property is improved such that the elastic pump delicately may descend without being distorted during deformation, contributing to an improvement in product reliability according to a precise operation of each component.

3 Claims, 7 Drawing Sheets

PUMP ASSEMBLY OF NON-METAL PUMP TYPE COSMETIC CONTAINER

CROSS-REFERENCE TO RELATED APPLICATION AND CLAIM OF PRIORITY

This application claims priority to Korean Patent Applications No. 10-2020-0028134 filed on Mar. 6, 2020 in the Korean Intellectual Property Office (KIPO), the entire disclosures of which are incorporated by reference herein in their entirety.

BACKGROUND

1. Technical Field

The present invention relates to non-metal pump type cosmetic containers, and more particularly, to a pump assembly of a non-metal pump type cosmetic container having an improved structure so that processing during recycling may be efficiently performed, smooth pumping may be achieved even by a small force, and a component for pumping a contained material may precisely operate.

2. Background Art

In general, cosmetic containers are configured such that, when a button is pressed, liquid is discharged, and include a metal spring for restoring a location of the button having descended back to its original location so that the button may ascend and descend.

According to conventional cosmetic containers including this metal spring, processing during recycling after use is difficult.

When all components are formed of a resin material in order to address this problem, cosmetic containers need to be designed such that a contained material may be smoothly pumped and a component for pumping the contained material may precisely operate.

SUMMARY

Provided is a pump assembly of a non-metal pump type cosmetic container by which processing during recycling is efficiently performed, smooth pumping is achieved even by a small force to thereby improve user's tactile sensitivity, and a component for pumping a contained material precisely operates.

According to an aspect of the present disclosure, a pump assembly of a non-metal pump type cosmetic container includes a connection nozzle connected to the inside of a container main body having a cylindrical shape in which a gel-type or liquid material is accommodated, such that a fluid is movable, the connection nozzle including an accommodating space where a material introduced from the container main body via pumping temporarily stays; an installation cap coupled to the container main body when the connection nozzle is supportably mounted on the installation cap, and arranged to surround the connection nozzle; a discharge cap provided to vertically ascend or descend along the inner circumferential surface of the installation cap, the discharge cap including an outlet that communicates with the connection nozzle such that the material may be discharged to the outside; a piston unit having one side that is connected to the discharge cap to ascend or descend together with the discharge cap, and the other side that is provided to be able to ascend or descend within the accommodating space of the connection nozzle, the piston unit including a discharge passage communicating with a discharge passage of the discharge cap, and a communication hole that enables selective communication between the discharge passage and the accommodating space of the connection nozzle while ascending together with the discharge cap; and an elastic pump arranged between the discharge cap and the connection nozzle, having an upper end supportably provided on an upper end of the piston unit and a lower end supportably provided on an upper end of the connection nozzle, and formed of an elastic material to restore the discharge cap descending together with the piston unit to its original location. The elastic pump includes a first portion in close contact with the exterior surface of the piston unit, and a second portion connected to the first portion and including an internal surface shape that forms a deformation gap for smooth deformation between the internal surface of the second portion, and upper and lower portions of the second portion having the deformation gap therebetween closely contact the exterior surface of the piston unit.

The second portion of the elastic pump may have a shape in which an inner diameter of the interior surface forming the deformation gap gradually increases from the upper side to the center and becomes maximum at the center and gradually decreases from the center to the lower side and there is no change in the outer diameter of the second portion.

The exterior surface of the piston unit may be stepped and thus includes a first exterior surface portion that the first portion of the elastic pump closely contacts, and a second exterior surface portion forming a step with respect to the first exterior surface portion and forming the deformation gap between the second exterior surface portion and the second portion of the elastic pump. The upper and lower portions of the second portion of the elastic pump having the deformation gap therebetween may be configured to have protrusions to closely contact the exterior surface of the piston unit.

The elastic pump may include a deformation groove formed between the first portion and the exterior surface of the second portion so that the first portion may be smoothly deformed.

A pump assembly of a non-metal pump type cosmetic container according to an embodiment of the present invention having the above-described structure replaces a metal spring providing an elastic restoring force from among the components of the non-metal pump type cosmetic container with an elastic pump formed of resin, thereby addressing conventional inconvenience and inefficiency of completely disassembling a product into metal parts and resin parts and then recycling the parts and accordingly improving convenience and efficiency in a recycling process. Due to an operation of the elastic pump that is more flexible than a rigid metal spring, pumping is achieved and thus a cosmetic material is sensitively discharged even by a small force, leading to increases in tactile sensitivity and operational sensitivity. In addition, the structure of the elastic pump formed of resin having a relatively good deformation property is improved such that the elastic pump delicately descends without being distorted during deformation, contributing to an improvement in product reliability according to a precise operation of each component.

DETAILED DESCRIPTION

Figure 1:
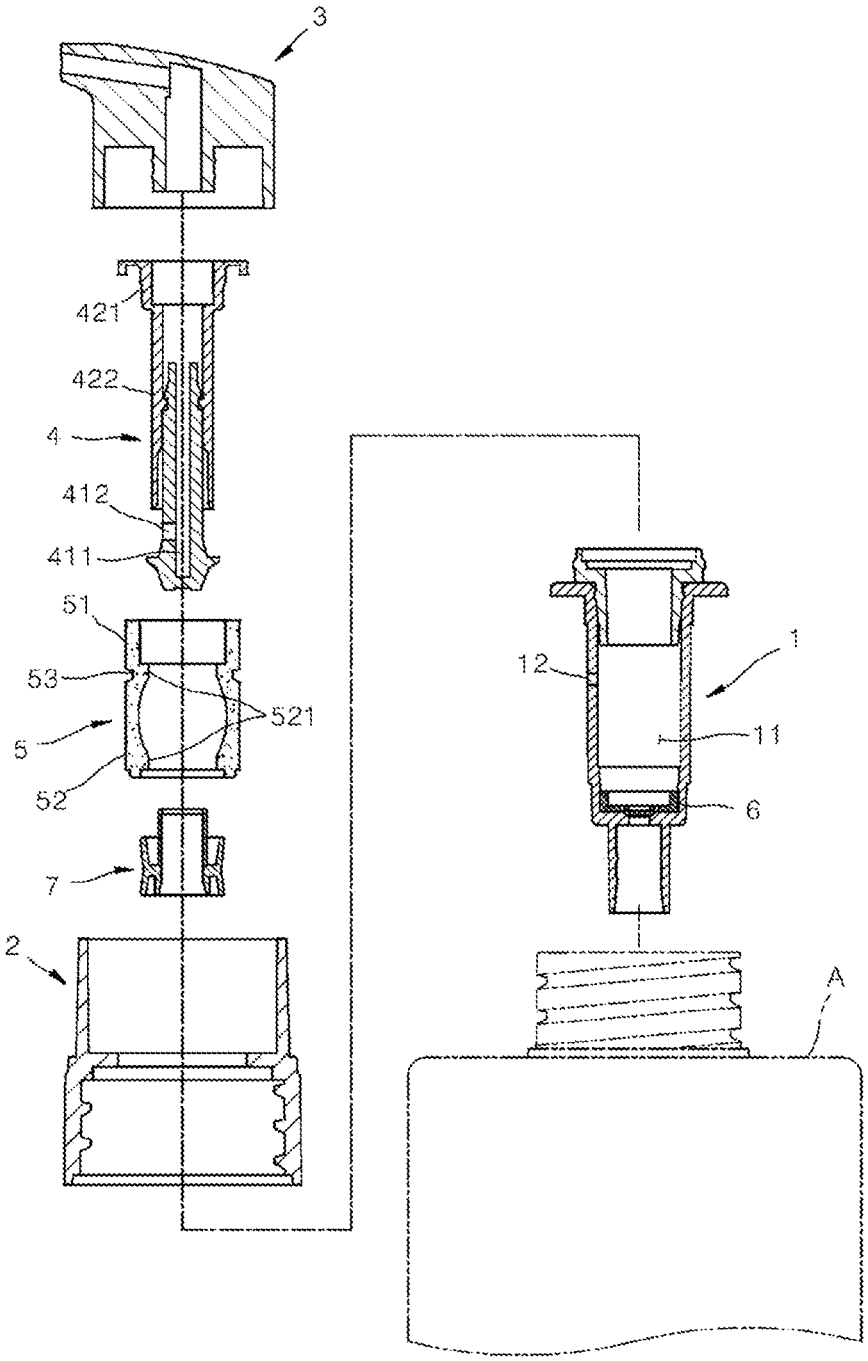
FIG. 1 is an exploded cross-sectional view of a non-metal pump type cosmetic container according to an embodiment of the present invention.

In the following description, in order to clarify the understanding of the present invention, descriptions of well-known technologies for the features of the present invention will be omitted. The following embodiment are detailed descriptions to help the understanding of the present invention, and it will be understood that the scope of the present invention is not limited. Accordingly, an equivalent invention that performs the same function as the present invention will also fall within the scope of the present invention.

In addition, in the following description, the same reference numerals or symbols means the same configuration, and unnecessary redundant description and description of known technology will be omitted. Moreover, a description of each embodiment of the present invention that overlaps with the description of the technology that is the background of the present invention will also be omitted.

A pump assembly of a non-metal pump type cosmetic container according to an embodiment of the present invention will now be described in detail with reference to the accompanying drawings.

Figure 2:
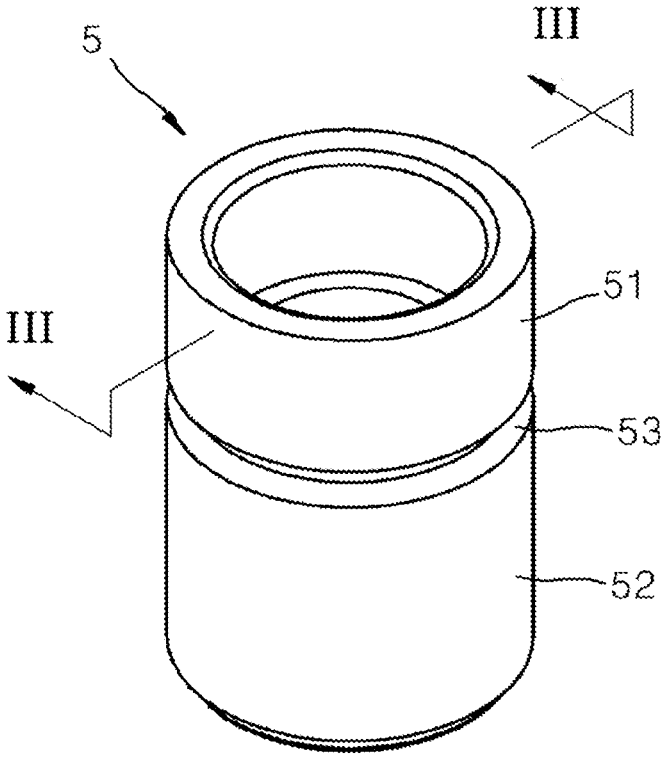
FIG. 2 is a perspective view of an elastic pump used in an embodiment of the present invention.
Figure 3:
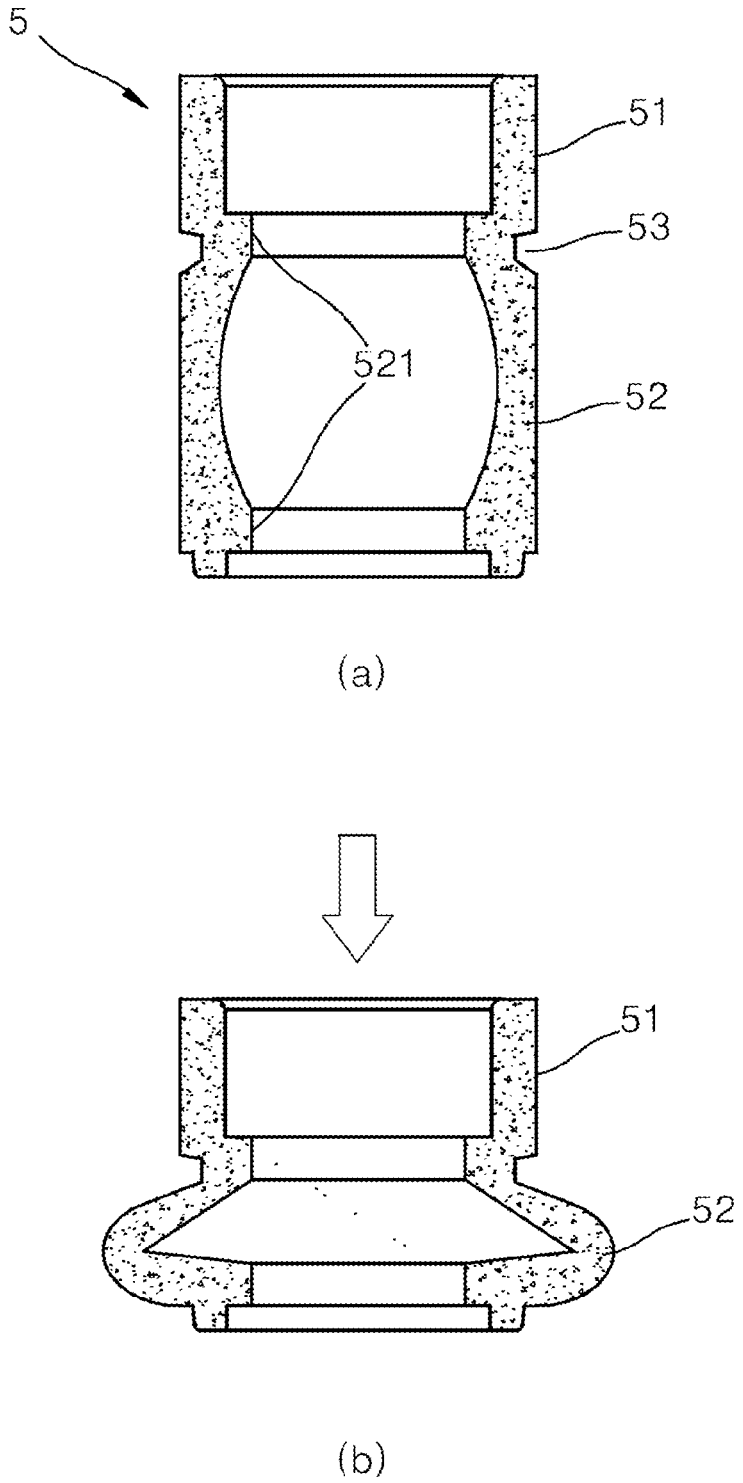
FIG. 3 includes (a) illustrating a cross-sectional view taken along line III-III of FIG. 2 to show a structure when deformation of the elastic pump does not occur, and (b) showing a structure when deformation of the elastic pump occurs.
Figure 4:
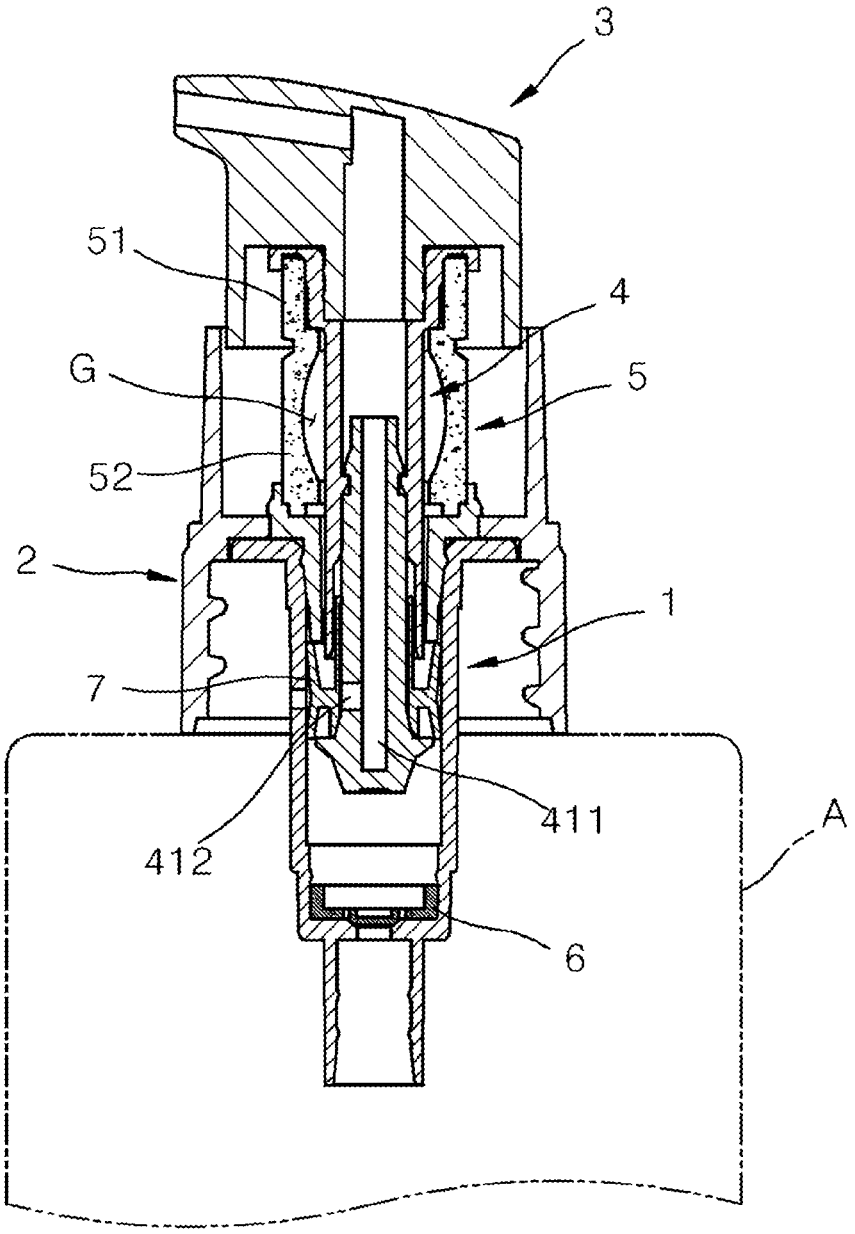
FIG. 4 is a cross-sectional view of an embodiment of the pump assembly of a non-metal pump type cosmetic container.
Figure 5:
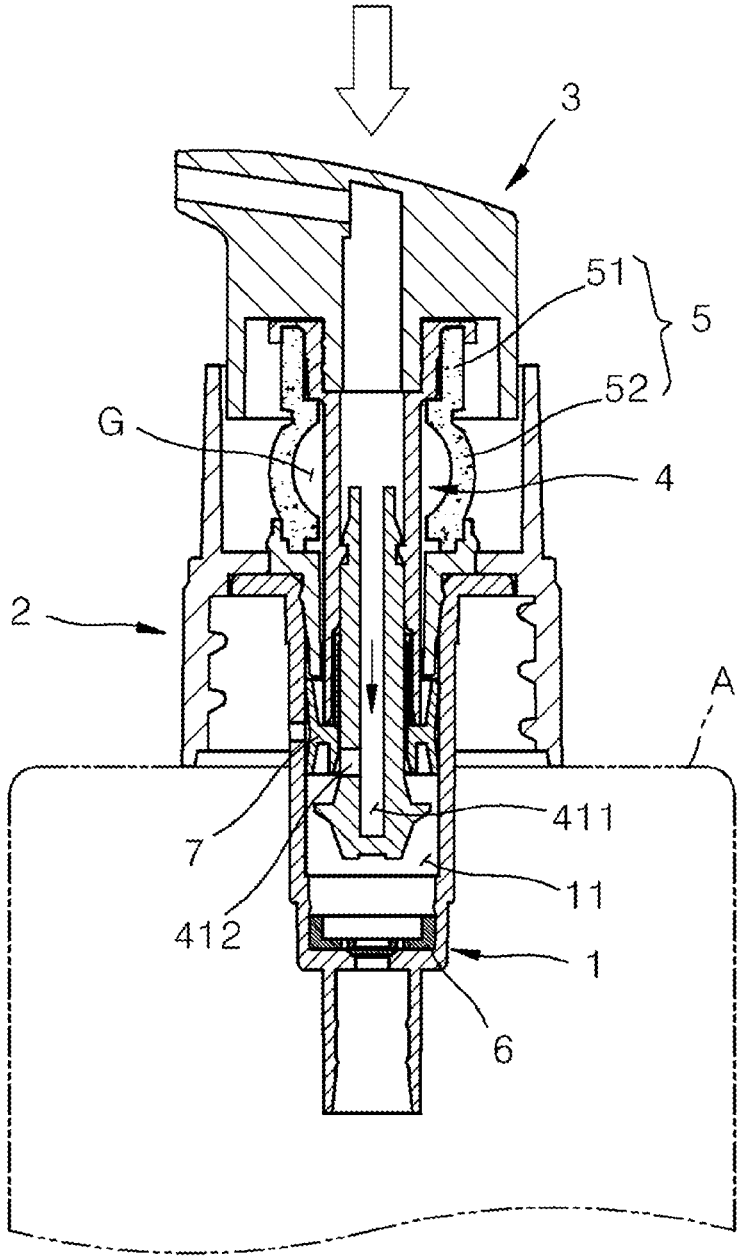
FIGS. 5 and 6 are views for explaining an operation of the embodiment of FIG. 4.
Figure 6:
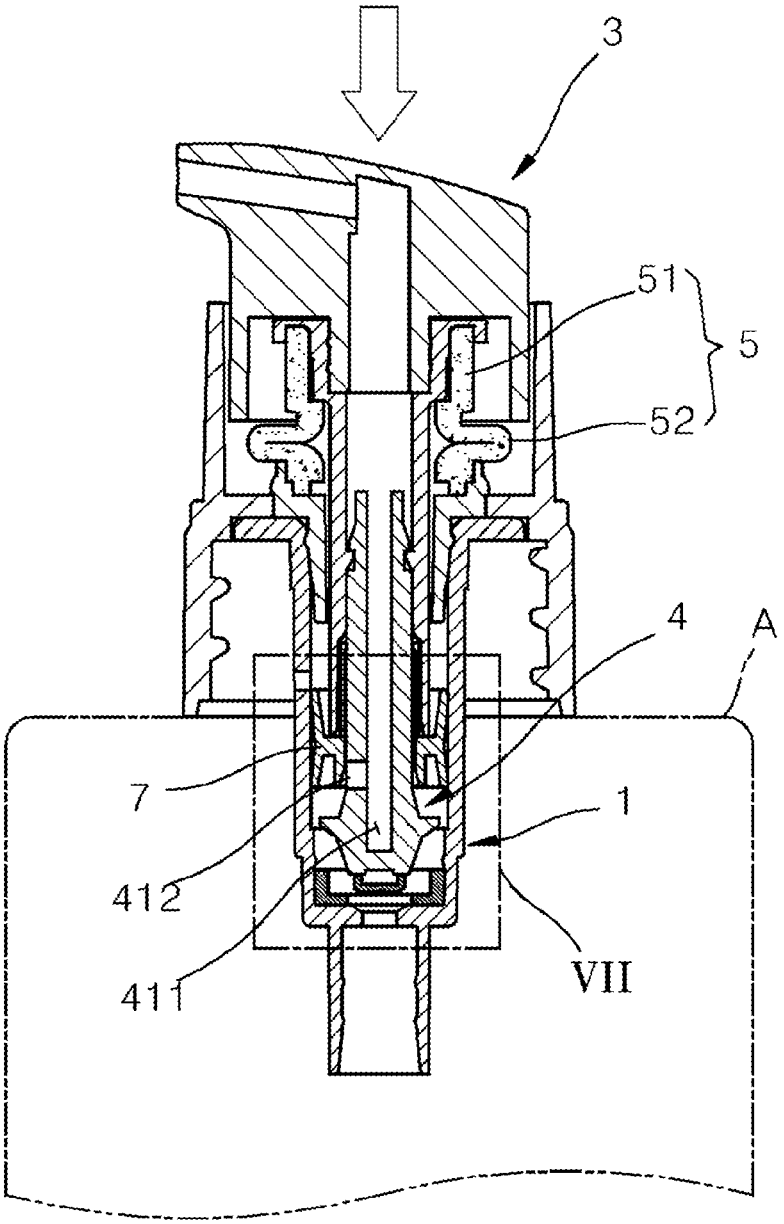
Figure 7:
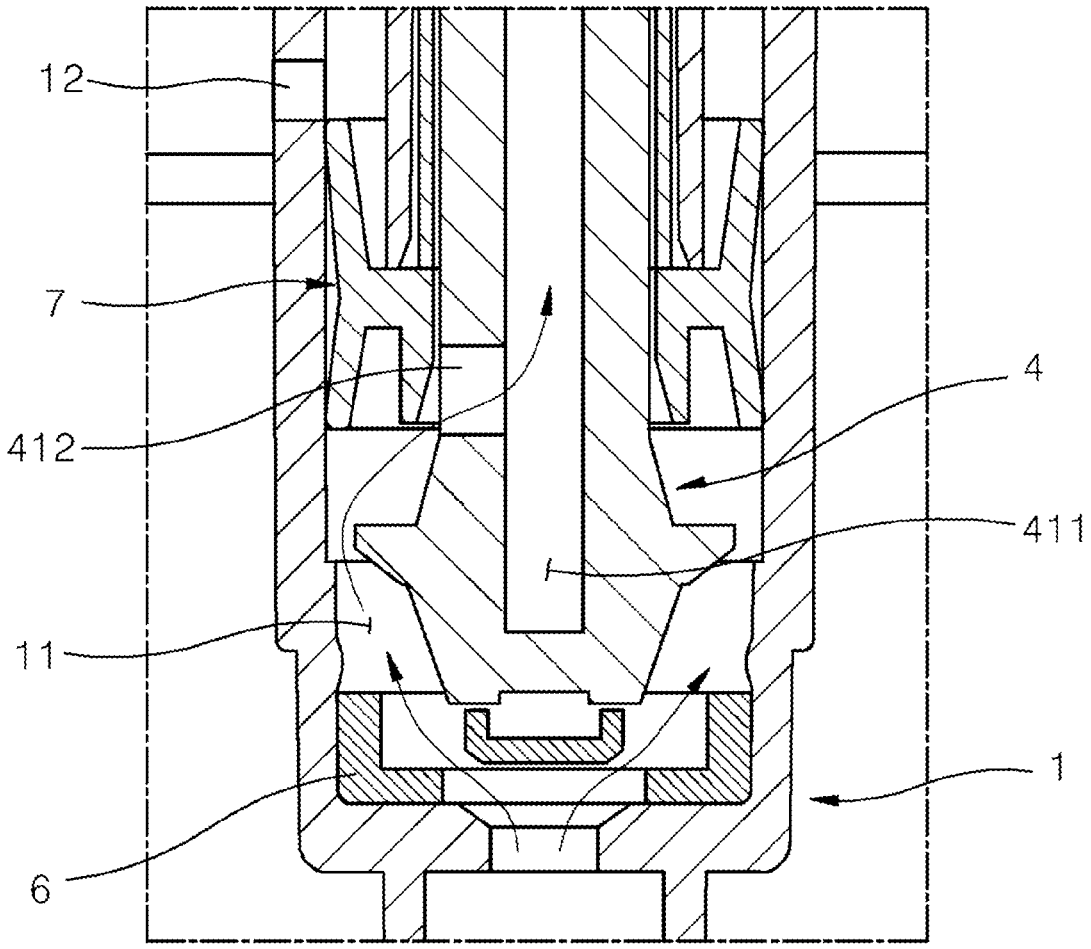
FIG. 7 is a magnified view of a portion VII of FIG. 6.

FIG. 1 is an exploded cross-sectional view of a non-metal pump type cosmetic container according to an embodiment of the present invention, FIG. 2 is a perspective view of an elastic pump used in an embodiment of the present invention, FIG. 3 is a cross-sectional view taken along line III-III of FIG. 2, FIG. 4 is a cross-sectional view of an embodiment of the present invention, FIGS. 5 and 6 are views for explaining an operation of an embodiment of the present invention, and FIG. 7 is a magnified view of a portion VII of FIG. 6.

As shown in FIGS. 1 and 4, a pump assembly of the non-metal pump type cosmetic container according to an embodiment of the present invention is coupled to a container main body A having a cylindrical shape to accommodate a gel-type or liquid material, and discharges the material accommodated in the container main body A to the outside, and includes a connection nozzle 1, an installation cap 2, a discharge cap 3, a piston unit 4, and an elastic pump 5.

The container main body A is a part in which the gel-type or liquid material is accommodated, and has a shape in which the top thereof is open. The material refers to, for example, cosmetics or a medical liquid.

The connection nozzle 1 is connected to the inside of the container main body A such that a fluid is movable, and includes an accommodating space 11 where a material introduced from the container main body A via pumping temporarily stays, to thereby provide a discharge path for the material.

The connection nozzle 1 is supportably mounted on the installation cap 2, and the installation cap 2 is coupled to the container main body A, and surrounds the connection nozzle 1. A structure for coupling the installation cap 2 with the container main body A may be implemented as various structures. However, according to the present embodiment, a screw coupling structure is used for convenience of coupling.

According to the present embodiment employing this coupling structure, the connection nozzle 1 is placed in the container main body A and the installation cap 2 is screwed and coupled to the container main body A, and thus the connection nozzle 1 and components supported on the connection nozzle 1 are firmly position-fixed.

The discharge cap 3 is provided to vertically ascend or descend along the inner circumferential surface of the installation cap 2. When a user presses the discharge cap 3, the discharge cap 3 descends, and thus the material accommodated in the container main body A is discharged. The discharge cap 3 is lifted by the elastic pump 5, which will be described later, and is returned to its original location. The discharge cap 3 includes an outlet that communicates with the connection nozzle 1 such that the material may be discharged to the outside.

The piston unit 4 has one side that is connected to the discharge cap 3 to ascend or descend together with the discharge cap 3, and the other side that is provided to be able to ascend or descend within the accommodating space 11 of the connection nozzle 1. Thus, when a pressing force is applied to the discharge cap 3, the piston unit 4 descends together with the discharge cap 3, and, when the pressing force is released, the piston unit 4 is lifted by the elastic pump 5.

The piston unit 4 includes a discharge passage 411 communicating with a discharge passage of the discharge cap 3, and a communication hole 412 that enables selective communication between the discharge passage 411 and the accommodating space 11 of the connection nozzle 1 while ascending together with the discharge cap 3.

According to the present embodiment having this structure, when the piston unit 4 descends together with the discharge cap 3 as shown in FIGS. 5 and 6, the communication hole 412 is made open so that the material enters the discharge passage 411 through the communication hole 412 and is then discharged to the outside through the discharge cap 3, as shown in FIG. 7 corresponding to a magnified view of FIG. 6, whereas, when the piston unit 4 ascends as shown in FIG. 4, the communication hole 412 is closed to prevent the material from being discharged to the outside.

A structure for selectively closing the communication hole 412 may be implemented as various structures. However, according to the present embodiment, the communication hole 412 is selectively closed by an interaction between a sealing ring 7 arranged within the connection nozzle 1 and the piston unit 4.

For example, when the piston unit 4 descends and the sealing ring 7 is thus moved to a location of opening the communication hole 412 as in FIGS. 5 and 6, the material accommodated in the connection nozzle 1 sequentially passes through the communication hole 412 and the discharge passage 411 of the piston unit 4 and then is discharged to the outside via the discharge cap 3, as in FIG. 7 corresponding to a magnified view of FIG. 6, and, when the piston unit 4 ascends and the sealing ring 7 is thus moved to a location of closing the communication hole 412, the material is prevented from being discharged to the outside.

The elastic pump 5 is arranged between the discharge cap 3 and the connection nozzle 1, as shown in FIG. 4. An upper end of the elastic pump 5 is supportably provided on an upper end of the piston unit 4, and a lower end of the elastic pump 5 is supportably provided on an upper end of the connection nozzle 1. The elastic pump 5 is formed of an elastic material to restore the discharge cap 3 descending together with the piston unit 4 to its original location.

The elastic pump 5 employed in the present embodiment has an improved structure so that smooth pumping may be achieved even by a small force to thereby improve user's tactile sensitivity and that each component for pumping the material accommodated in the connection nozzle 1 may precisely operate.

In other words, as shown in FIGS. 2 and 3, the elastic pump 5 includes a first portion 51 in close contact with the exterior surface of the piston unit 4, and a second portion 52 connected to the first portion 51 and including an internal surface shape that forms a deformation gap G for smooth deformation between the internal surface of the second portion 52 and the exterior surface of the piston unit 4, thus not closely contacting the exterior surface of the piston unit 4. A portion of the second portion 52 where the deformation gap G is formed is spaced apart from the exterior surface of the piston unit 4, but upper and lower portions of the second portion 52 having the deformation gap G therebetween closely contact the exterior surface of the piston unit 4.

When the discharge cap 3 descends due to a pressing force from a user, because the first portion 51 and the upper and lower portions of the second portion 52 having the deformation gap G therebetween closely contact the exterior surface of the piston unit 4, the elastic pump 5 is able to delicately descend along the exterior surface without being distorted, thus enabling the discharge cap 3 and the piston unit 4 to precisely descend. Consequently, product reliability is increased.

The elastic pump 5 includes the second portion 52 where the deformation gap G is formed, and thus, in contrast with a comparative embodiment in which the deformation gap G is not formed and thus the elastic pump 5 receives resistance from the exterior surface of the piston unit 4 while being deformed, namely, being crushed, and accordingly is not smoothly deformed, the material is pumped even by a small force due to the smooth deformation, and thus the user's tactile sensitivity is increased.

The pump assembly of the non-metal pump type cosmetic container according to an embodiment of the present invention having the above-described structure replaces a metal spring providing an elastic restoring force from among the components of the non-metal pump type cosmetic container with the elastic pump 5 formed of resin, thereby addressing conventional inconvenience and inefficiency of completely disassembling a product into metal parts and resin parts and then recycling them and accordingly improving convenience and efficiency in a recycling process. Due to an operation of the elastic pump 5 that is more flexible than a rigid metal spring, pumping is achieved and thus a cosmetic material is sensitively discharged even by a small force, leading to increases in tactile sensitivity and operational sensitivity. In addition, the structure of the elastic pump 5 formed of resin having a relatively good deformation property is improved such that the elastic pump 5 delicately descends without being distorted during deformation, contributing to an improvement in product reliability according to a precise operation of each component.

According to the present embodiment, the piston unit 4 is formed by separately manufacturing a portion of the piston unit 4 that is arranged in the connection nozzle 1 and a portion thereof that is connected to the discharge cap 3 and supports the upper end of the elastic pump 5 and then coupling the two separately-manufactured portions to each other. However, embodiments of the present invention are not limited thereto, and the piston unit 4 may be integrally formed using a single material.

According to the present embodiment, similar to the piston unit 4, the connection nozzle 1 is formed by separately manufacturing a portion of the connection nozzle 1 that supports the elastic pump 5 and a portion of the connection nozzle 1 that is arranged in the container main body A and then coupling the two separately-manufactured portions to each other. However, the connection nozzle 1 may be integrally formed using a single material.

The elastic pump 5 may be manufactured to have elasticity by being formed of a resin material such as elastomer, and may be manufactured using also resin such as PP or PE in order to also have a mechanical property such as hardness.

As shown in FIGS. 2 and 3, the second portion 52 of the elastic pump 5 employed in the present embodiment has a shape in which an inner diameter of the interior surface forming the deformation gap G gradually increases from the upper side to the center and becomes maximum at the center and gradually decreases from the center to the lower side and there is no change in the outer diameter of the second portion 52.

According to the present embodiment having such a structure, the thickness of the center of the second portion 52 is smallest and the thickness of the second portion 52 gradually increases from the center to both sides, and thus, as shown in b of FIG. 3 and FIG. 6, even when repetitive deformations of the elastic pump 5 occur, irregular distortion in other portions does not occur, and instead distortion occurs mainly at the center. Thus, a consistent and delicate operation is achieved, and accordingly a regular amount of cosmetic liquid that is relatively proportional to a pressure may be discharged.

The exterior surface of the piston unit 4 may be stepped and thus may include a first exterior surface portion 421 that the first portion 51 of the elastic pump 5 closely contacts, and a second exterior surface portion 422 forming a step with respect to the first exterior surface portion 421 in order to facilitate formation of the deformation gap G between the second exterior surface portion 422 and the second portion 52 of the elastic pump 5.

The portion of the second portion 52 of the elastic pump 5, where the deformation gap G is formed, is configured to be spaced apart from the exterior surface of the piston unit 4, but the upper and lower portions of the second portion 52 having the deformation gap G therebetween are configured to have protrusions 521 to closely contact the exterior surface of the piston unit 4.

According to the present embodiment having such a configuration, protrusions of the second portion 52 are formed on the upper and lower sides having the deformation gap G therebetween, and thus guide a stable ascending or descending operation of the elastic pump 5.

The elastic pump 5 includes a deformation groove 53 formed between the first portion 51 and the exterior surface of the second portion 52 so that the first portion 51 may be smoothly deformed.

In other words, the deformation groove 53 enables the entire elastic pump 5 to be smoothly deformed, by quickly inducing initial deformation before the entire elastic pump 5 is entirely deformed. For example, when a heavy car is moved by a human force, the heavy car is easily moved after initial movement occurs. Like a case where a generation time point of the initial movement is shortened by using another tool, an initial descending operation of the elastic pump 5 is performed early by using the deformation groove 53, and thus the entire elastic pump 5 may be smoothly deformed.

Reference numeral 12 is an air communication hole 412 through which air existing between the container main body A and the connection nozzle 1 is introduced toward the connection nozzle 1 or is discharged toward the container main body A, and reference numeral 6 indicates an opening and closing member capable of selectively introducing the material accommodated in the container main body A toward the connection nozzle 1.

Although various embodiments of the present invention have been described above, the present embodiments and the drawings attached to the present specification merely show a part of the technical spirit included in the present invention. It will be apparent that modifications and specific embodiments that can be easily inferred by those skilled in the art within the scope of the technical idea are included in the scope of the present invention.

What is claimed is:

1. A pump assembly of a non-metal pump type cosmetic container, the pump assembly comprising:

a connection nozzle connected to the inside of a container main body having a cylindrical shape in which a gel-type or liquid material is accommodated, such that a fluid is movable, the connection nozzle including an accommodating space where a material introduced from the container main body via pumping temporarily stays;

an installation cap coupled to the container main body when the connection nozzle is supportably mounted on the installation cap, and arranged to surround the connection nozzle;

a discharge cap provided to vertically ascend or descend along an inner circumferential surface of the installation cap, the discharge cap including an outlet that communicates with the connection nozzle such that the material is discharged to the outside;

a piston unit having one side connected to the discharge cap to ascend or descend together with the discharge cap, and the other side provided to be able to ascend or descend within the accommodating space of the connection nozzle, the piston unit including therein a discharge passage communicating with a discharge passage of the discharge cap and a communication hole that enables selective communication between the discharge passage and the accommodating space of the connection nozzle while ascending or descending together with the discharge cap; and an elastic pump arranged between the discharge cap and the connection nozzle, the elastic pump comprising an elastic material to restore the discharge cap descending together with the piston unit to an original location, the elastic pump comprising:

an upper end supportably provided on an upper end of the piston unit;

a lower end supportably provided on an upper end of the connection nozzle;

a first portion in close contact with an exterior surface of the piston unit; and a second portion connected to the first portion, the second portion comprising an internal surface shape forming a deformation gap for smooth deformation between an internal surface of the second portion and upper and lower portions having the deformation gap therebetween closely contact the exterior surface of the piston unit, wherein the exterior surface of the piston unit is stepped and thus includes a first exterior surface portion that the first portion of the elastic pump closely contacts, and a second exterior surface portion forming a step with respect to the first exterior surface portion and forming the deformation gap between the second exterior surface portion and the second portion of the elastic pump; and the upper and lower portions of the second portion of the elastic pump having the deformation gap therebetween are configured to have protrusions to closely contact the exterior surface of the piston unit.

2. A pump assembly of a non-metal pump type cosmetic container, the pump assembly comprising:

a connection nozzle connected to the inside of a container main body having a cylindrical shape in which a gel-type or liquid material is accommodated, such that a fluid is movable, the connection nozzle including an accommodating space where a material introduced from the container main body via pumping temporarily stays;

an installation cap coupled to the container main body when the connection nozzle is supportably mounted on the installation cap, and arranged to surround the connection nozzle;

a discharge cap provided to vertically ascend or descend along an inner circumferential surface of the installation cap, the discharge cap including an outlet that communicates with the connection nozzle such that the material is discharged to the outside;

a piston unit having one side connected to the discharge cap to ascend or descend together with the discharge cap, and the other side provided to be able to ascend or descend within the accommodating space of the connection nozzle, the piston unit including therein a discharge passage communicating with a discharge passage of the discharge cap and a communication hole that enables selective communication between the discharge passage and the accommodating space of the connection nozzle while ascending or descending together with the discharge cap; and an elastic pump arranged between the discharge cap and the connection nozzle, the elastic pump comprising an elastic material to restore the discharge cap descending together with the piston unit to an original location, the elastic pump comprising:

an upper end supportably provided on an upper end of the piston unit;

a lower end supportably provided on an upper end of the connection nozzle;

a first portion in close contact with an exterior surface of the piston unit; and a second portion connected to the first portion, the second portion comprising an internal surface shape forming a deformation gap for smooth deformation between an internal surface of the second portion and upper and lower portions having the deformation gap therebetween closely contact the exterior surface of the piston unit, wherein the second portion of the elastic pump has a shape in which an inner diameter of the interior surface forming the deformation gap gradually increases from an upper side to a center and is maximum at the center and gradually decreases from the center to a lower side, and there is no change in the outer diameter of the second portion.

3. The pump assembly of claim 1, wherein the elastic pump includes a deformation groove formed between the first portion and the exterior surface of the second portion so that the first portion is smoothly deformed.

5

* * * * *